US005242062A

United States Patent [19]

Engravalle

[11] Patent Number: 5,242,062

[45] Date of Patent: Sep. 7, 1993

[54] DISPLAY FOR GREETING CARDS

[76] Inventor: Linda K. Engravalle, 1436 N. High Dr., McPherson, Kans. 67460

[21] Appl. No.: 932,893

[22] Filed: Aug. 20, 1992

[51] Int. Cl.[5] ..... A47F 7/00

[52] U.S. Cl. ..... 211/45; 40/124; 40/124.4

[58] Field of Search ..... 211/45, 87, 40, 41; 40/124, 124.2, 124.4

[56] References Cited

U.S. PATENT DOCUMENTS

| | | | |
|---|---|---|---|
| 942,713 | 12/1909 | Cope . | |
| 1,676,492 | 7/1928 | Goodwin | 40/124.4 |
| 2,959,879 | 11/1960 | Mazur . | |
| 3,581,419 | 6/1971 | McCracken | 40/124 |
| 4,372,067 | 2/1983 | Ruffino . | |
| 4,571,867 | 2/1986 | Williams | 40/124.4 X |
| 4,993,560 | 2/1991 | Jaffe . | |
| 5,097,961 | 3/1992 | Patino et al. . | |

*Primary Examiner*—Robert W. Gibson, Jr.
*Attorney, Agent, or Firm*—D. A. N. Chase; Michael Yakimo, Jr.

[57] ABSTRACT

A device for displaying greeting cards and the like comprises a flat, relatively thin display member which is secured to a flat mounting surface of a selected support, such as a wall, door or mirror. The cards are inserted into slots in the member, the inserted portion of a card being captured in a narrow space that is provided between the display member and the mounting surface. Special securing means on the member serve as spacers to maintain the narrow capture space and hold the displayed portion of each card in an upright position to be viewed.

7 Claims, 2 Drawing Sheets

Fig. 1
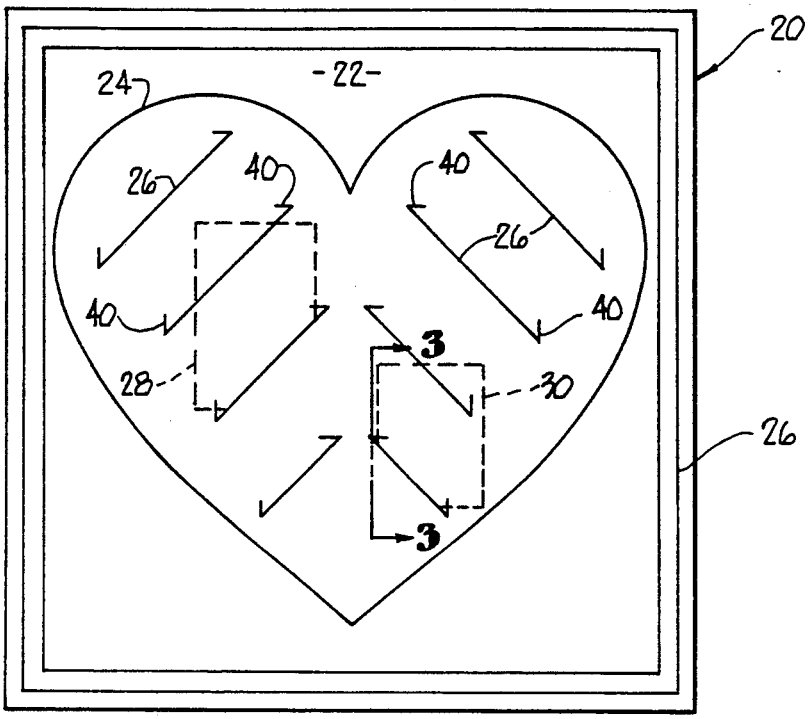
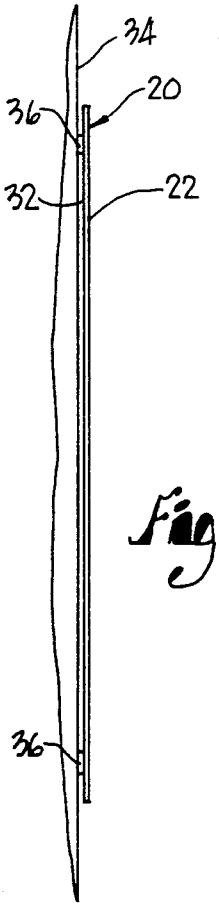
Fig. 2
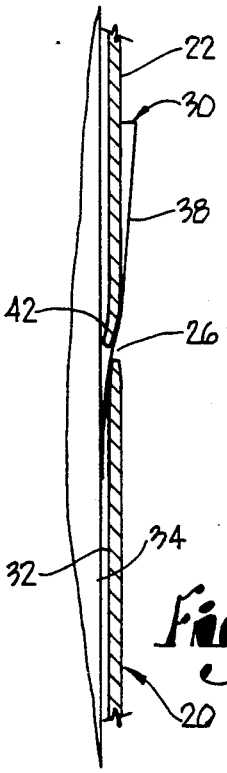
Fig. 3
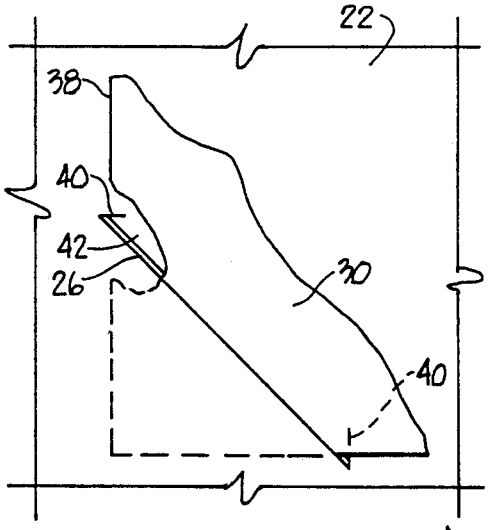
Fig. 4

DISPLAY FOR GREETING CARDS

BACKGROUND OF THE INVENTION

This invention relates to an improved display for greeting cards and the like, and in particular to a device employing a display board which may be readily mounted on any flat surface that the user may select and which holds the cards upright so they ma be viewed and enjoyed.

Greeting cards and cards for special occasions are sent and received as a common social expression. Special events and holidays, and occurrences in a person's life may result in one receiving a number of cards to be read and remembered. Oftentimes, greeting cards are simply stacked in a pile when received and thus must be handled to be enjoyed. If set up on a horizontal surface, they frequently fall over and require constant attendance.

Although cards may be accumulated and displayed, for example, by securing them to a bulletin board with thumbtacks or pins, this requires a special board structure that must be mounted on a particular wall surface on a permanent basis. Not all wall surfaces are suitable. Alternatives include the use of magnets to hold the cards on metallic surfaces such as presented by the door of a refrigerator or other appliance, but some of the cards are inevitably dislodged by the normal opening and closing of the door. In short, unless a special place is allocated for cards in a home, office, school, hospital or other institution, their display and hence enjoyment is often limited to the time in which a card is initially received, removed from the envelope and read.

SUMMARY OF THE INVENTION

It is, therefore, the primary object of the present invention to provide a display for greeting cards which permits them to be viewed and enjoyed on a continuing basis from any selected display location that provides a flat, upright surface.

As a corollary to the foregoing object, it is an important aim of this invention to provide a device in the nature of a display board which may be conveniently secured to a flat mounting surface provided by a support that may be selected by the user, such as a wall, door, mirror or appliance.

Another important object of the invention is to provide such a device which positively holds the card in an upright position to be viewed, by capturing a portion of the card between the display board and the mounting surface.

Still another important object is to provide such a device in which the display member, in the nature of a flat, relatively thin board or the like, is secured to the mounting surface in a manner to provide a narrow space between the board and the surface for capturing a portion of a card inserted through a slot in the member and confining the inserted portion within such space, thereby holding the displayed portion of the card in an upright position to be viewed.

Still another important object of the invention is to provide such a display member which is composed of bendable material and provides flaps at the respective card-receiving slots therein capable of being bent inwardly to provide clearance for ease of insertion of the cards into the narrow capture space.

Yet another object is to provide a convenient and easy to use means for securing the display member to the mounting surface provided by a selected support, wherein such securing means maintains the narrow capture space between the member and the surface.

Furthermore, it is an important object of this invention to provide a device as aforesaid having a design on the front face of the display member appropriate to the recipient, the sender of the card, or a particular occasion.

Other objects will become apparent as the detailed description proceeds.

DESCRIPTION OF THE DRAWINGS

FIG. 1 is a front elevational view of the device of the present invention, showing two inserted cards in broken lines.

FIG. 2 is a side view of the device of FIG. 1 as seen viewing the left edge thereof and showing the display member secured to a vertical mounting surface, the spacing of the member from the surface being exaggerated for clarity.

FIG. 3 is an enlarged, vertical sectional view taken along line 3—3 in FIG. 1, the mounting surface being added to show the manner in which a card is held by the device.

FIG. 4 is an enlarged, fragmentary, front view of the portion of the device seen in FIG. 1 adjacent the section line 3—3.

DETAILED DESCRIPTION

Figure 5:
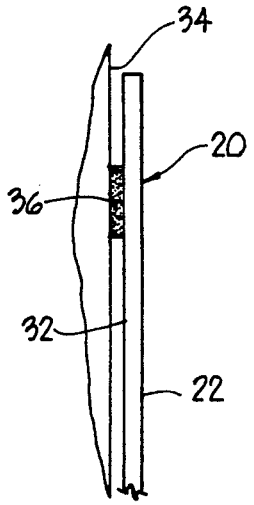
FIG. 5 is an enlarged, fragmentary, side view of the upper portion of the device as seen in FIG. 2.
Figure 6:
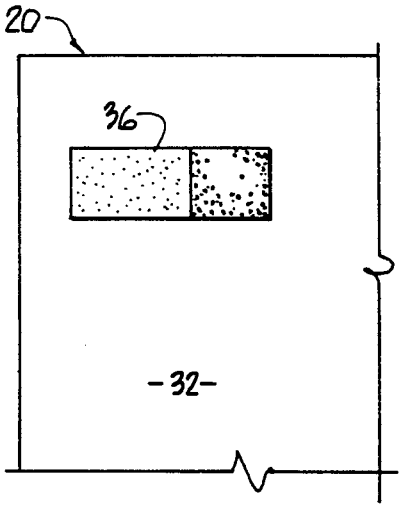
FIG. 6 is a fragmentary, rear view of the device showing one of the adhesive mounting tabs.

Referring initially to FIG. 1, a display member 20 is shown which is of square configuration and is composed of a thin, flat material such as corrugated cardboard or a suitable plastic having characteristics to be discussed below. The front face 22 of the member 20 is seen in FIG. 1 and is provided with a design appropriate for Valentine's Day, as an example of an occasion on which the device would be used. Accordingly, a heart design 24 is printed on the front face 22 along with a square border 26 adjacent the edge of the member 20. It should be understood that the design may be of any character as appropriate and could appear on a separate sheet laminated to member 20.

A number of slots 26 are cut in member 20 and are spaced from one another over a major portion of front face 22. Each of these slots 26 may receive a greeting card such as illustrated at 28 and 30. One corner of each of the cards 28 and 30 is inserted into the respective slot 26 as shown in detail in FIG. 4 with respect to card 30. In FIG. 4 the portion of the card 30 in full lines is adjacent the front face 22 and constitutes the displayed portion of the card, whereas the lower left corner of the card 30 shown in broken lines is hidden from view and is adjacent the rear face 32 of the member (FIG. 3).

The slots 26 may be cut in the member 20 by any suitable means, such as a die cutting process in the course of fabrication of the members 20. As may be seen by a close observation of FIG. 3, the use of a cutting die to form the slots 26 causes a slight compression of the material where the slots are cut, which assists in providing the necessary clearance for insertion of the card as will be discussed.

Figure 7:
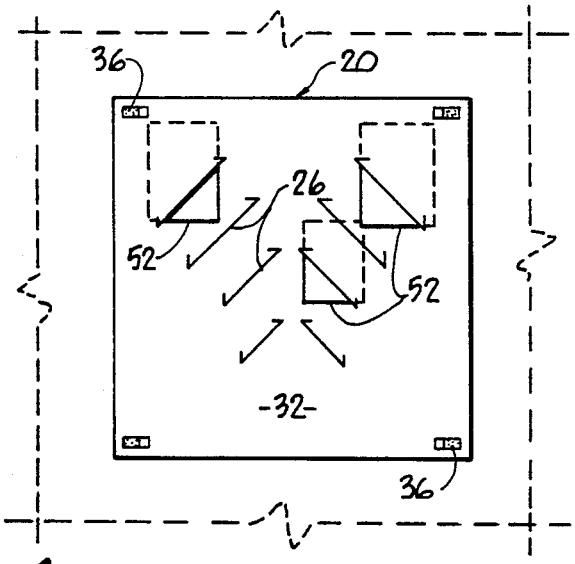
FIG. 7 is a rear view of the device on a smaller scale than FIG. 1 as it would appear viewing the same through a transparent window pane to which the device is secured, the presence of the window being illustrated by broken lines.

The display member 20 is shown secured to a vertical mounting surface in FIGS. 2 and 5 by adhesive tabs 36 which also serve to provide a narrow space between the rear face 32 of member 20 and mounting surface 34 and ensure that such space is maintained. Four such tabs 36 adjacent the corners of the member 20 may be employed as shown in FIG. 7. This narrow space between the rear face 32 and the mounting surface 34 captures the corner portion of a card that is inserted through a respective slot 26, as seen in FIG. 3 where card 30 is illustrated. In particular, as shown in FIG. 3 the inserted corner is confined in this narrow space between the rear face 32 and the mounting surface 34 so that the inserted portion of the card only diverges slightly from the vertical plane of member 20, thereby holding the displayed portion of card 30 in an upright, essentially vertical orientation. This is evident in comparing FIGS. 3 and 4 by noting that the folded edge 38 of the card 30 is not permitted to project outwardly toward the viewer but, instead, extends upwardly as shown.

Referring to FIGS. 1 and 4, it may be seen that slits 40 at the ends of the slots 26 form a "V" configuration at each end in order to provide a flap 42 at each slot 26 capable of being bent inwardly toward the mounting surface 34 to provide clearance for an inserted card (FIG. 3). A material such as corrugated cardboard provides this characteristic as would a plastic material selected for its ability to be bent to a slightly deflected position.

The mounting tabs 36 employed in the present invention are particularly important in that they provide the necessary spacing between the rear face 32 and the mounting surface 34 to maintain the narrow capture space and provide the supporting action for the card illustrated in FIG. 3. It has been found that double-sided, adhesive wall mounting tabs are particularly advantageous for this purpose as they provide the requisite spacing and also provide a convenient means to quickly secure the display member 20 to the selected support. Double-sided foam wall mounting tabs sold by 3M of St. Paul, Minn., U.S.A. are suitable for this purpose.

Figure 8:
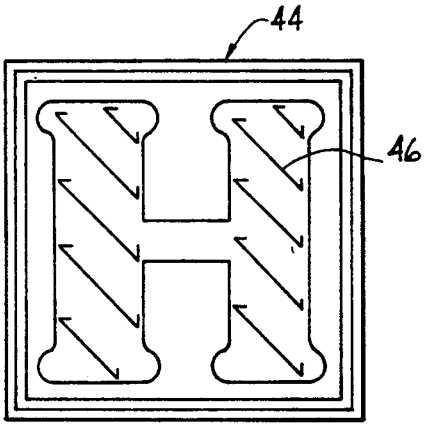
FIG. 8 is a front view of an alternative form of the device of FIG. 1, showing an "H" design on the front face of the display member and a variation in the arrangement of the card-receiving slots to accommodate the H design.
Figure 9:
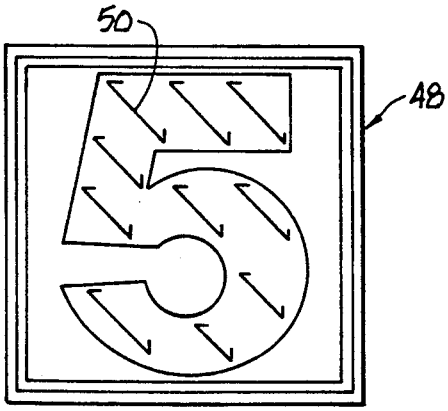
FIG. 9 is a front view of another alternative form showing a design in the form of the numeral "5" and slots to accommodate the design.

FIG. 8 and FIG. 9 illustrate two display members 44 and 48 respectively having different designs and an arrangement of slots 46 and 50 to accommodate those designs. The "H" design in FIG. 8 would be appropriate, for example, as a gift for a person whose name begins with that letter. The "5" design on the display member 46 would make it appropriate as a birthday gift for a five year old. It is evident, therefore, that the design can be fashioned to accommodate a particular individual, a particular occasion, or a commercial design if desired.

In use, the display member 20 (or 44 or 48) is secured to the selected support by applying the mounting tabs 36 to the rear face 32 of the member and then pressing the tabs against the mounting surface 34. As illustrated in FIGS. 2, 3 and 5, application of the member to the wall or other support in this manner leaves the capture space between the member and the mounting surface as discussed above. If desired, prior to mounting the member the user may depress the tabs 42 at the slots 26 to provide additional clearance for cards that will be inserted.

As shown in FIG. 3, as the lower left edge of card 30 is inserted into the slot 26 from the front of the member 20, it contacts the surface 34 and is guided downwardly within the narrow space between the opposed face 32 and surface 34 until the card is fully inserted. By being thus confined and held close to the rear face 32, the exposed portion of the card 30 adjacent the front face 22 is maintained in the upright, essentially vertical orientation discussed above and illustrated in FIG. 3 for convenient and pleasing viewing.

FIG. 7 illustrates the rear face 32 as seen when the display member 20 is secured to a transparent support such as a pane of glass. The inserted lower portions of three cards 52 are visible from the rear of the member 20 through the glass against which they are pressed.

It should also be appreciated that the present invention may be advantageously utilized in institutional applications as well as homes and offices. Student's rooms and nursing homes typically provide small personal living areas where the display of the present invention is especially appropriate due to its ability to be mounted wherever a wall surface is available.

Having thus described the invention, what is claimed as new and desired to be secured by Letters Patent is as follows:

1. In combination with a selected support having a flat, upright mounting surface, a device for displaying greeting cards and the like comprising:

a flat, relatively thin display member provided with opposed, front and rear faces and having a slot therein communicating said faces, said slot being adapted to receive a card or the like inserted thereinto from the front of said member, whereby the inserted card presents a displayed portion adjacent said front face and an inserted portion adjacent said rear face, and means on said member for securing the same to said mounting surface of the selected support and establishing a narrow space between said rear face and said surface for capturing the inserted portion of a card and confining the inserted portion between said rear face and said surface, whereby the displayed portion of the card is held in an upright position to be viewed.

2. The device as claimed in claim 1, wherein said member has a plurality of said slots therein spaced from one another over a major portion of said front face.

3. The device as claimed in claim 2, wherein said front face has a design thereon extending over at least part of said major portion.

4. The device as claimed in claim 1, wherein said member is composed of bendable material and has means cooperating with said slot to present a flap capable of being bent inwardly toward said mounting surface to provide clearance for an inserted card.

5. The device as claimed in claim 1, wherein said slot has a pair of ends, and wherein said member is composed of bendable material and has slits therein at said ends cooperating with the slot to present a flap capable of being bent inwardly toward said mounting surface to provide clearance for an inserted card.

6. The device as claimed in claim 1, wherein said securing means includes a plurality of spacer elements between said rear face and said surface for maintaining said narrow space therebetween.

7. The device as claimed in claim 1, wherein said securing means comprises a plurality of spaced-apart, adhesive mounting tabs between said rear face and said surface having sufficient thickness to maintain said narrow space therebetween.

* * * * *

UNITED STATES PATENT AND TRADEMARK OFFICE

CERTIFICATE OF CORRECTION

PATENT NO. : 5,242,062

DATED : September 7, 1993

INVENTOR(S) : Linda K. Engravalle

It is certified that error appears in the above-indentified patent and that said Letters Patent is hereby corrected as shown below:

Column 1, line 9, after the word "they" delete "ma" and insert --may-- therefor.

Signed and Sealed this

Twenty-eighth Day of June, 1994

Bruce Lehman

*Attest:*

BRUCE LEHMAN

*Attesting Officer*

*Commissioner of Patents and Trademarks*